United States Patent [19]

Bossa, deceased

[11] 4,279,538

[45] Jul. 21, 1981

[54] ANTI-POLLUTION AND ANTIFIRE FLOATING BARRIER

[75] Inventor: Edoardo Bossa, deceased, late of Rome, Italy, by Maria Piera Ferzero, Loriana Bossa, Ivo Bossa, legal representatives, heirs

[73] Assignee: Covalca Plastici S.p.A., Pomezia, Italy

[21] Appl. No.: 103,058

[22] Filed: Dec. 13, 1979

[30] Foreign Application Priority Data

Dec. 19, 1978 [IT] Italy ..... 52352 A/78

[51] Int. Cl.[3] ..... E02B 15/04

[52] U.S. Cl. ..... 405/66; 405/70

[58] Field of Search ..... 405/63, 66, 68, 70; 210/242, DIG. 25

[56] References Cited

U.S. PATENT DOCUMENTS

| | | | |
|---|---|---|---|
| 3,613,377 | 10/1971 | Zaugg | 405/68 |
| 3,701,258 | 10/1972 | Rhodes | 405/63 |
| 3,921,407 | 11/1975 | Neal | 405/66 X |
| 3,971,220 | 7/1976 | Kinase et al. | 405/66 |

FOREIGN PATENT DOCUMENTS

| | | | |
|---|---|---|---|
| 7200529 | 7/1973 | Netherlands | 405/66 |

*Primary Examiner*—David H. Corbin

[57] ABSTRACT

The barrier of this invention is formed by barrier sections and each of them can be wound up about a reel or bobbin, which is pivotably mounted within a main floating hollow element, which not only has the task of receiving, transporting, towing, launching and trawling the barrier section housed therein, but also it serves to provide anchoring points for this barrier. Each main barrier element is shaped in the form of a cage-like container provided with at least a side vertical entrance passage, through which a barrier section can be returned inside the container, or this section can be caused to come out, each main floating element thus serving as floating container for the transport of at least one of the barrier sections to or from their use place.

6 Claims, 11 Drawing Figures

ANTI-POLLUTION AND ANTIFIRE FLOATING BARRIER

An anti-pollution and antifire floating barrier having main floating elements to be used as containers for the collection, transport and launching of the barrier sections.

The present invention relates to an anti-pollution and antifire floating barrier, consisting of a continuous flexible strip, constituted of barrier sections each formed of vertical flexible wall elements connected by juxtaposed cylindrical vertical floating bodies provided with counterweight bodies and adapted to maintain each barrier section in vertical position so as to enable to form a barrier for enclosing polluted areas of a sea, lake, river and the like.

Various type of barriers for similar intended purposes have been already disclosed, the most part of which includes floating bodies extending horizontally and connected to each other in series and these barriers can be easily launched, but they do not offer any good protective effectiveness owing to their low stability and, as a consequence thereof, owing to their low resistance, especially when these barriers are used in waters exposed to the effects of rough sea. Moreover these barriers cannot be wound up on support recovery means. Other different known types of barriers have the disadvantage to occupy large space, to be very heavy and very difficult to be correctly positioned, so that their launching in an area to be protected, or from which polluting layers have to be removed, becomes long and very expensive.

The barrier of this invention is formed by barrier sections and each of them can be wound up about a reel or bobbin, which is pivotably mounted within a main floating hollow element, which not only has the task of receiving, transporting, towing, launching and trawling the barrier section housed therein, but also it serves to provide anchoring points for this barrier. Each main barrier element is shaped in the form of a cage-like container provided with at least a side vertical entrance passage, through which a barrier section can be returned inside the container, or this section can be caused to come out, each main floating element thus serving as floating container for the transport of at least one of the barrier sections to or from their use place.

By using this floating barrier any intervention operation becomes very quick, since it will be sufficient to transport on the place, optionally by towing means, a plurality of main barrier elements of the barrier, each including at least one barrier section and housing the recovery spool for the barrier section or sections in order to be able to perform the launching of the barrier elements or their recovery.

These main floating elements are substantially constituted of cylindrical hollow bodies having an adjustable buoyancy, at least the lower portion of which is substantially open or constituted by a lattice structure. These main barrier elements have a central hollow drum, about which at least a section or length of barrier has to be wound up, this drum being provided with means for the hooking of the or each barrier section, as well as with means for causing the drum to rotate about its axis in both directions. In the inner cavity of this hollow drum is housed an anchoring implement supported by a cable or chain which is connected to a winch, by means of which the anchoring implement is caused to sink towards the bottom of the sea or the like; or it is caused to get aweigh up to return this latter again into its seat within the main barrier container, after this latter has recalled and let the section or sections of barrier, connected thereto, wound up about its inner drum. Soon after, this main barrier element can be transferred from a place to another.

In fact, when a barrier element has been wound about a spool or drum, mounted inside the hollow container, this latter can be transported anywhere; in particular it can be winched and taken on board of a ship or it can be taken on tow by any suitable towing means. This container could be also provided with a self-propelled engine.

For particular intended purposes, provision could be made to position and anchor the main barrier floating elements containing the respective barrier sections, in the guise of buoys, in those water, zones where their utilization may be probable, for instance, about an oiler being discharged. In this case, as soon as a damage occurs, in a very short time a continuous barrier defence can be formed which entirely encircles the polluted zone, taking out the barrier sections from the respective main barrier elements and connecting the barrier sections to each other.

When the barrier of this invention is in its operative position, it becomes also possible to create quickly openings for the passage of lighters or other service ships, letting one barrier section to enter at least partially within the respective main floating container.

It is to be pointed out that, for instance, a main floating barrier element, which has an overall weight of about 16 tons and an outer diameter of about 8 m, can house a barrier section about 500 m long. Afterwards, such a main floating barrier container has been brought on the use site and about 10 minutes were necessary for unwinding and positioning each barrier section, housed therein and which can be connected with other barrier sections unwound from other main barrier containers, so that during a time interval of about 1 hour, when, for instance, six main barrier containers of the aforementioned features would be used for the enclosure a water surface of a perimeter of about 3000 m. and of a maximum area of about 500.000 $m^2$ can be obtained with a defence capacity of this barrier which according to recent tests and searches has been proved to be sufficient, in the most part of emergency cases, for insuring an effective preventive or defensive protection of any stationary or movable plant which could cause, or which has caused, pollutions or which has to be isolated for other particular purposes.

According to the present invention it becomes thus possible to perform quickly the launching and the recovery of vertical self-floating protective barriers sections of the type comprising articulated element and which are the most appropriate barriers devices for the defence of an area of polluted water or also for other purposes. As compared with the known barriers, the barrier of this invention is constituted of barrier sections or lengths which are flexible and self-floating and each of them is formed by a plurality of vertical wall portions made of cloth or flexible metal plate, among which are interposed spaced vertical floating bodies so that each barrier section can be easily recovered and collected inside one of the main floating barrier containers, wherein the barrier section is wound about a drum connected with driving means; this operation can be directly carried out on the water surface, so that soon after a barrier section has been recalled within the respective container, this latter acts as a self-floating, self-propelled or towable container, can be towed by any suitable towing means or which can be hoisted on a tender or the like by means of a common luff tackle without any difficulty, since the barrier section or length is now enclosed and protected by the peripheral walls thereof.

As a result thereof, in the event that the protection barrier has to be installed in open sea, for instance, in order to circumscribe a spot of oily material which is streamed or striming from an oiler, the tender or mother ship can run towards said oily spot, carrying the barrier containers which are necessary, and which will be put down on the polluted water about the area to be enclosed. Then the mechanical unwinding devices are actuated which let each barrier section to come out of the respective container, while the barrier section ends are guided by an operator on board of a boat; then the free outer end of one barrier section will be connected to the end of another barrier section, coming out of another container so as to enclose the area to be isolated.

Before or after having circumscribed this area, from each container will be caused to fall down on the sea bottom the respective anchoring means in order to maintain the obtained barrier in the desired position.

According to this solution, no other anchoring means will be required for the barrier. Owing to the easy launching and recovery of the barrier sections according to this invention, the barrier will have a production and operation cost very reduced, so that it can also be used for enclosing any water area for any intended purpose.

These and other characteristics of the invention will be better understood by the following description of an embodiment of the invention, taking in consideration the accompanying drawings, in which.

Figure 1:
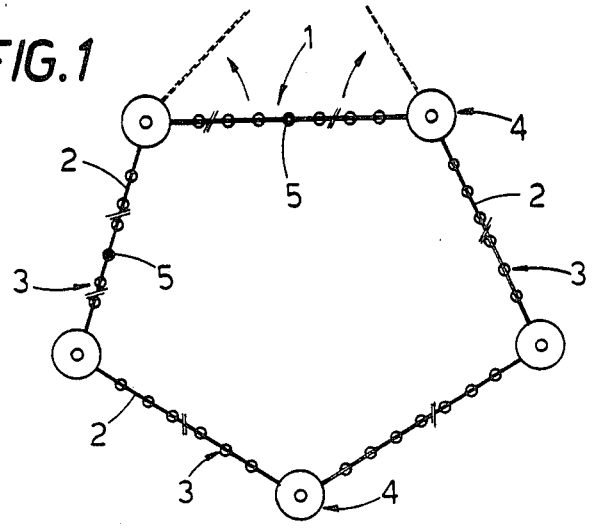
FIG. 1 is a diagrammatical view of a barrier defence system according to the present invention.
Figure 2:
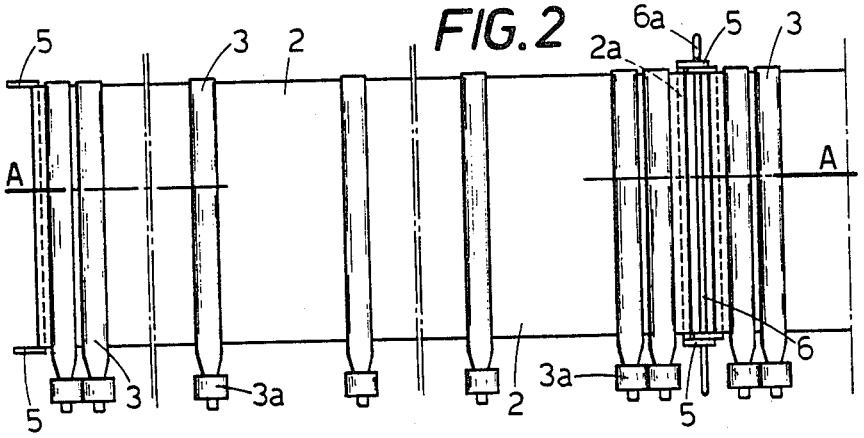
FIG. 2 is a side view of a barrier portion in enlarged scale.
Figure 3:
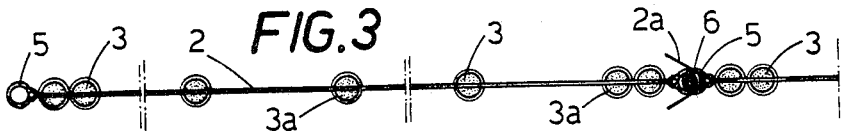
FIG. 3 is a horizontal section of a barrier portion taken on the line A—A of FIG. 2.
Figure 4:
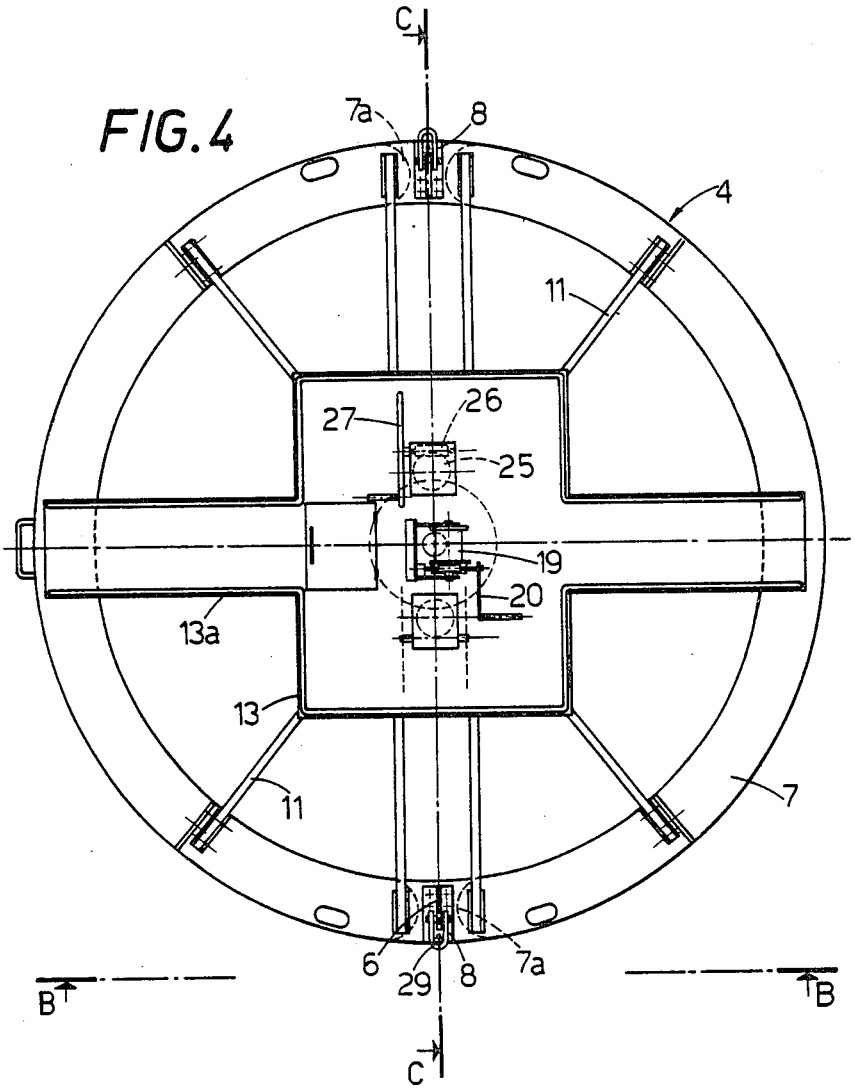
FIG. 4 is a top view of a main barrier element.
Figure 5:
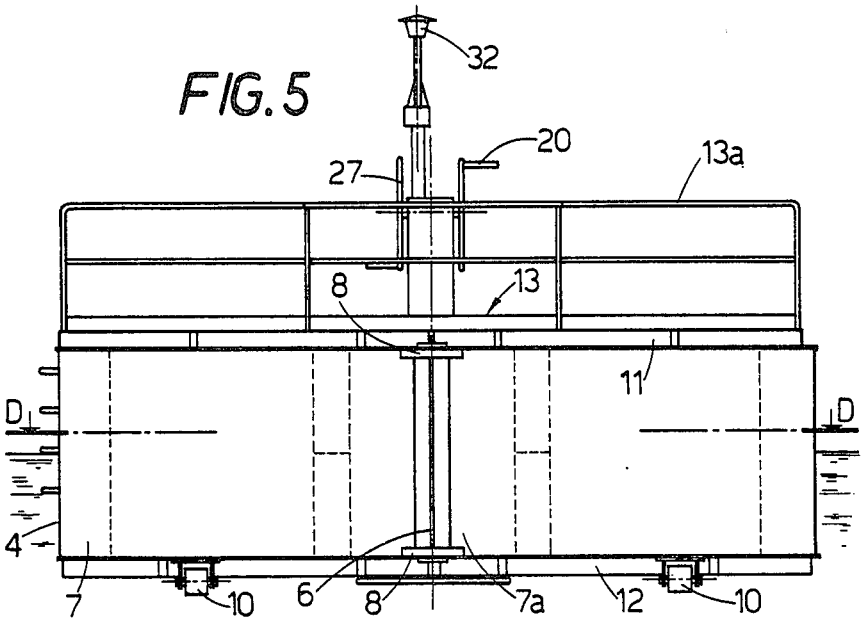
FIG. 5 is a side view taken from the line B—B of FIG. 4.

Now, referring to FIG. 1, by 1 are generally indicated the barrier sections, for obtaining a barrier defence. Each barrier section 1 is formed by vertical wall elements 2 made of plasticized or padded cloth, of flexible metal sheet or of other suitable materials and which are connected to juxtaposed floating cylindrical bodies 3, while by 4 are indicated the main barrier elements which are the main devices of the present floating barrier. The cylindrical bodies 3 may have a circular, polygonal, elliptical or the like cross section. Preferably, the bodies 3 are made of a foamed plastic material and are moulded in two halves, which will be then welded to one another, locking therebetween a continuous plasticized cloth strip which in the part comprised between two adjacent bodies 3, forms a barrier wall element 2. In order to maintain vertical each barrier section 1, the bodies 3 are provided with a lower counterweight 3*a*. The ends of each barrier section 1 are provided with a pair of rings 5 adapted to be connected to similar rings 5 of another barrier section 1 by means of vertical bars 6 provided with an upper gripping means 6*a* and handle, for instance, or to be hooked to a main barrier element 4, as it will be hereinafter disclosed. Furthermore, the ends of the barrier sections 1 have a pair of outwardly extending vertical limbs 2*a*, provided with closure means adapted to close the joint passage created between two barrier elements 1 in the joint zones. Each of the main barrier elements 4 (FIGS. 4 to 9) consists of a hollow floating container having a perforated bottom and which is constructed so as to be self-floating, also when inside of it is housed a barrier section 1, considering that each barrier section 1 is "per se" self-floating. Each barrier section or length 1 is designed to be wound about a drum rotatably movable in both directions by driving means of a manual or automotive kind, which permit to return the flexible barrier section or length 1 within the respective main barrier element 4 causing the barrier section 1 to be wound about the said drum, or vice-versa. Now, referring in particular to FIGS. 4 to 6, each main bobbin element 4 consists of an outer cylindrical cavity wall 7 of a height greater than that of each barrier section 1, said cavity wall 7 forming an outer peripheral floating annular body, preferably constructed in two halves of semi-annular shape, having closed end portions 7*a* which are so shaped as to form surfaces adapted to assist the entrance and the exit of the barrier section or sections 1 to and from the vertical side passages formed between the facing shaped end portions 7*a*, spaced apart from one another (FIGS. 4 and 5). Therefore, the end portions 7*a* are connected to one another at their upper and lower ends by connecting straps 8 fixed to the ends 7*a* of the semi-cylindrical hollow bodies 7.

The straps 8 are so dimensioned that the width of the entrance orifices is greater than the maximum thickness of each barrier section 1, while the height of the main barrier element 4 is such that the height of entrance orifice is greater than that of the barrier section 1, so that during the maneuvers each barrier section 1 cannot friction slide against parts of the main barrier element 4, so that each barrier section or length 1 can wound about or unwound from the drum of a main barrier element 4 with a very reduced stress. In order to block the entrance orifices of each barrier element 4, after a barrier section or length 1 has been entirely or only partially wound on the drum within a barrier element 4, a locking bar 6 is provided, similar to those which are utilized for connecting the barrier lengths 1 to each other, the said bar 6 being inserted across each entrance orifice and being provided with a gripping handle 6*a*, for instance, this bar 6 passing through coaxial holes arranged on the connecting straps 8. The bars 6,6*a* co-operating with the straps 8 could also serve for the hooking of the rings 5, fastened to the ends of another barrier section 1 to a main barrier element 4.

The semi-annular hollow bodies 7 are fixedly connected to radial upper and lower tie rods 11 and 12, the upper tie rods 11 being fixed to a central platform 13 carrying the driving devices which will be hereinafter described, said platform 13 being made integral with a service foot bridge 13*a*. From said platform 13 extends downwardly a cylindrical wall 14, the lower portion of which is connected to the lower tie rods 12, underneath of which are mounted wheels 10 provided to assist the displacement of each element 4 along a solid surface or on the ground, when the main barrier element 4 has been removed from the water surface and has been brought ashore or on a tender or mother ship. The wall 14 defines a central cavity or well, at the upper part of which a tubular hollow body 15 is housed constituting an adjustable ballast floating caisson so as to adjust, at will, the water line of the respective main barrier element 4.

For such a purpose, a down-pipe 9 is provided on the bottom of the caisson 15, controlled by a foot valve (not shown), so as to permit to vary the volume of the ballast liquid present inside the caisson 15 through which is arranged an axial conduit 15*a*, along which passes the anchoring cable 17, supporting an anchoring member 18, the cable 17 passing through a hole of the platform wall 13 and winding about a winch 19 mounted on the platform 13 and provided with a self-braking means (not shown) and which is actuated by manual or a motor control means.

Figure 6:
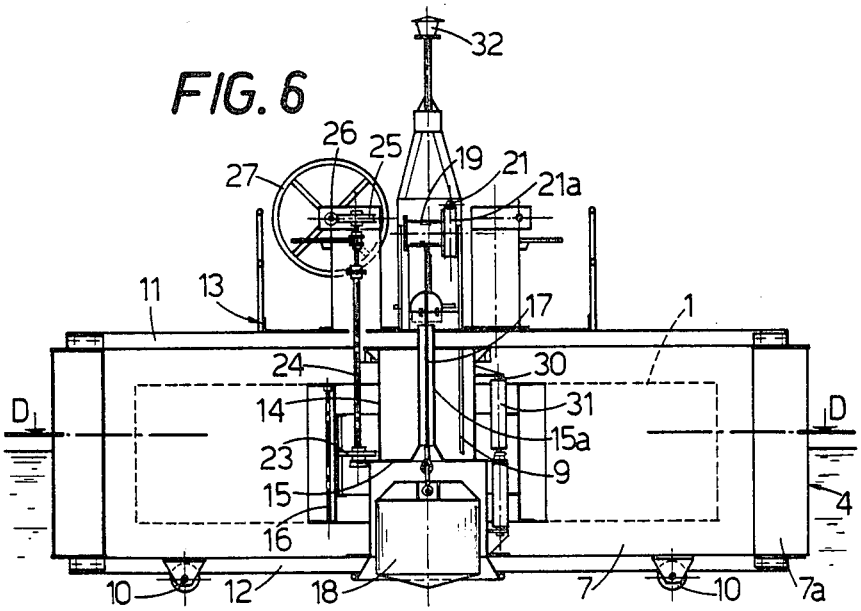
FIG. 6 is the axial section taken on the line C—C of FIG. 4, when a barrier section is housed within said main barrier element and this latter is in its floating condition, this position of said barrier element being indicated by broken lines.
Figure 7:
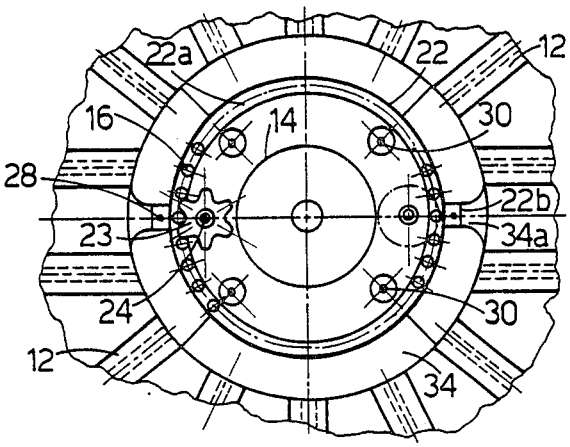
FIG. 7 shows the detail of the central portion of the main barrier element of the section taken on line D—D of FIGS. 5 and 6.
Figure 9:
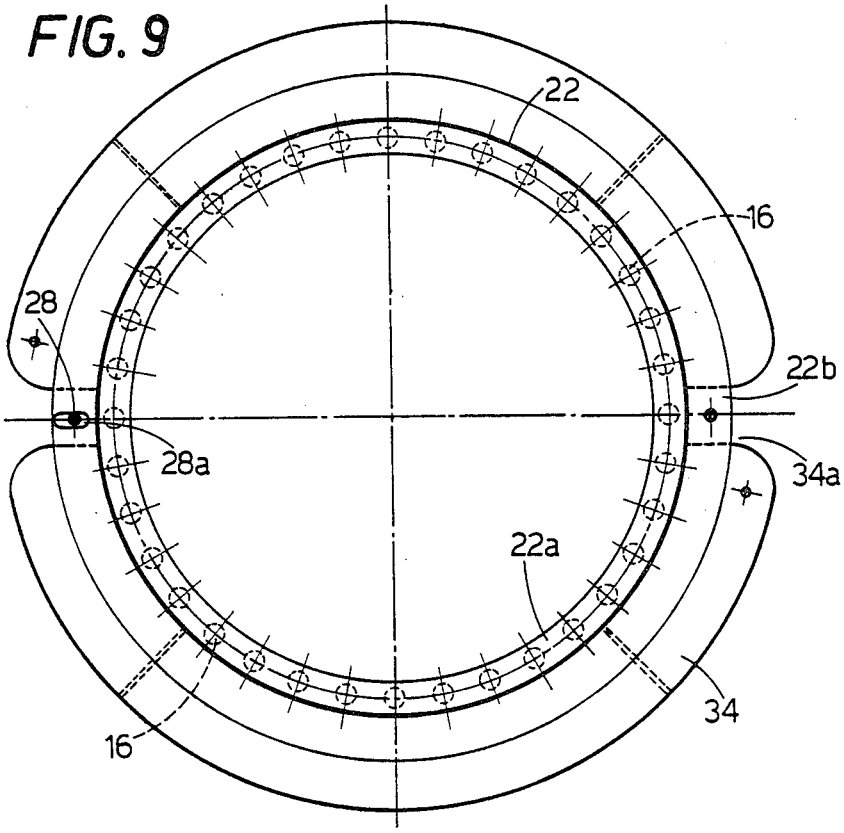
FIG. 9 is the detail, in enlarged scale, of the plan view of the winding drum.
Figure 8:
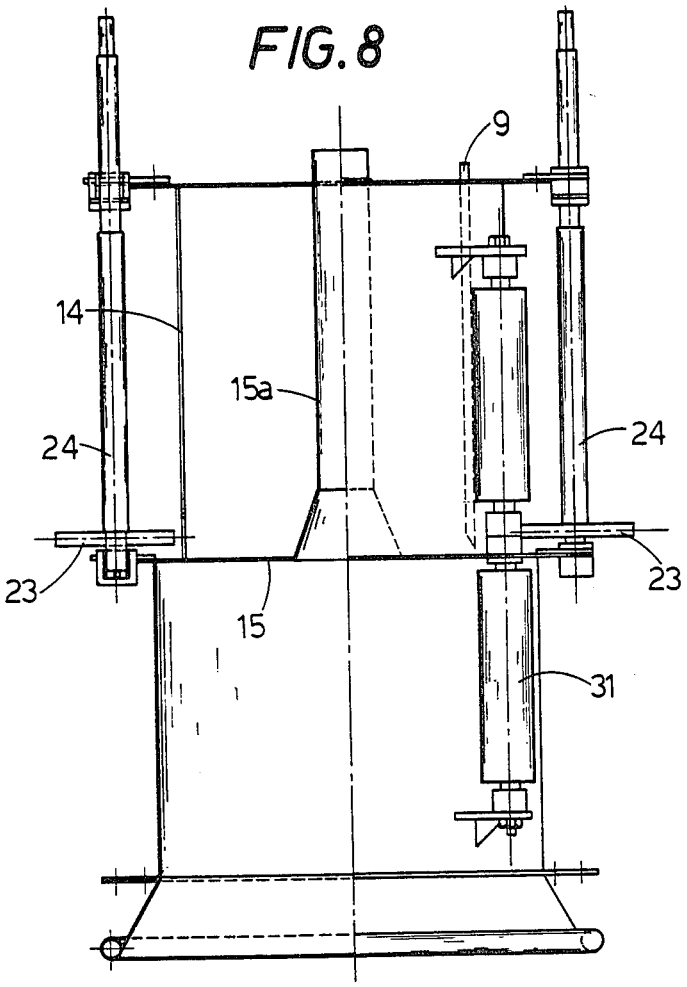
FIG. 8 shows, in enlarged scale, a detail of FIG. 6.

In the shown embodiment of the barrier, which is of a construction of low cost, a simple manually actuable lever arm 20 is provided, by means of which a worm screw 21*a* is actuated meshing with a screw wheel 21, keyed on the shaft of the winch 19. By 22 is indicated a drum mounted coaxially and about the cylindrical wall 14 and which can freely slide up and down along its vertical axis (FIG. 6). The drum 22 has a diameter larger than that of the cylindrical wall 14, so as to define together with this latter, an annular air gap designed to house the means for the transmission means transmitting the motion in both directions to revolving drum 22. For such a purpose the drum 22 has at its ends inner flanges 22*a* which support a plurality of vertical rollers 16 (FIGS. 7 and 9), with which meshes at least a pinion 23 mounted on a vertical shaft 24 which extends upwardly beyond the platform 13 and has at its upper end a screw wheel 25, engaging a worm screw 26 which is actuated by a handwheel 27, but, of course, which could be also actuated by any transmission system connected with a driving shaft of an engine of any suitable type.

In the shown embodiment is provided a transmission system of the movement to the drum 22 actuated by a manual control device, 27, but, of course, the actuating devices could be two or more. If a control device actuated by the during shaft of an engine is provided with a single control pinion 23 will be sufficiently connected with a single motion transmission.

The drum 22 is provided with outer flanges 22*b*, by means of which it is fixedly connected to an outer annular hollow caisson 23 forming a third floating body. The caisson 34 has at least one recess 34 (two recesses in the shown embodiment). The ends of the recess 34 are at least partially closed by the flanges 22 which are provided in these zones of holes through which can be inserted a removable bar 28 having a gripping handle 28*a* and designed to be engaged in the rings 5 mounted at one end of a barrier section 1. The drum 22 has a height slightly greater than that of the barrier sections 1, and each barrier section 1, together with the drum 22, can slide up and down inside the main barrier element 4 along the vertical axis thereof, thus remaining always spaced apart from the upper and lower parts of the main barrier element 4 in which the barrier section 1 is received.

The normal position of a barrier section 1 and of the drum 22 connected thereto, within the respective main barrier element 4, is the central position shown by broken lines in FIG. 6. The height of the inner annular room obtained inside the main barrier element 4 and designed to receive the barrier section 1, depends upon the condition which can be expected of the water surface where the barrier sections 1 have to be normally used, so that barrier elements 4 of a smaller height will be provided, in the event that the barrier has to be used in smooth waters and vice versa.

By 29 are indicated connection handles fastened, for instance, to the straps 8 and to be used for manoeuvring the main barrier element 4 or to assist the mooring thereof; the handles 29 could also serve as fastening means for the tow cable which will be used when a main barrier element 4, housing at least one barrier length 1, has to be towed.

The same handles 29 can be used for hooking the cables of a ship which, in the event that provision is made that the transfert, the launching and the recovery of the barrier sections 1 and of the main barrier elements 4 arg carried out with the help of a mother ship or the like. In order to maintain the correct central position of the revolving drum 22 a plurality of vertical shafts 30 can be provided, carried by the wall 14, about which are mounted idle guiding rollers 31 in contact with the plurality of rollers 15 and which are located in the annular room defined between the revolving drum 22 and the cylindrical wall 14.

Each main barrier element 4 will be preferably provided with a signal flash lamp 32 for signalling, during the night, the presence of the barrier defence to the ships sailing in this water site.

Figure 10:
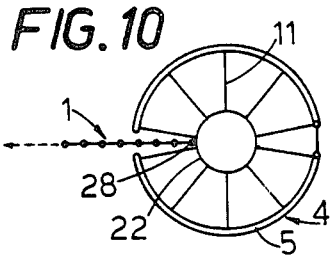
FIGS. 10 and 11 show, diagrammatically, a main bobbin element housing one barrier section (FIG. 10) and respectively a bobbin member (FIG. 11) housing two barrier sections which will be launched from two diametrally opposite positions of a main barrier element.
Figure 11:
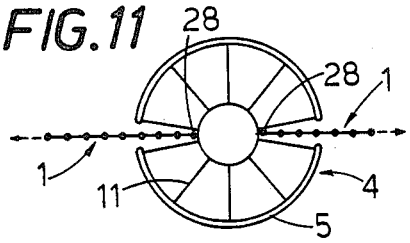

Each barrier element 4 can house one or two barrier sections 1. In the first case (FIG. 10) the rings 5 of one end of the single barrier section 1 are connected to the drum 22 by a bar 28, while in the second case the rings 5 of one end of two barrier sections 1 are fixed to the same drum 22 at diametrally opposite points, so that from the opposite sides of each barrier element can come out two barrier sections 1, which are unwound from the same drum 22 and which had been previously wound up on said drum 22 in interlacing loops.

I claim:

1. An anti-pollution and antifire barrier to be used on water surfaces or the like, characterized in that it comprises, in combination:

barrier sections (1) consisting of laminar, flexible, vertical wall portions (2) connected by interposed substantially cylindrical vertical floating bodies (3) provided with lower counterweight means (3*a*);

main barrier elements (4) each connected to at least one barrier section (1) and each constituted of a hollow container with perforated bottom and comprising floating bodies, each container (4) housing a hollow revolving drum (22) slidable up and down along a vertical axis and connected with means adapted to rotate this drum (22) about said vertical axis in both directions, each main barrier element (4) being constituted of a peripheral annular vertical floating caisson (7) having at least one side entrance orifice of a height greater than that of the barrier sections (1) and of a width greater than the maximum thickness of each barrier section (1), in the inner space defined inside the drum (22) being mounted a cylindrical wall (14) housing at the upper part of its inner cavity a floating caisson (15) containing an adjustable amount of a ballast means, while the lower part of this cavity constitutes a seat for receiving an anchoring body (18) in the inoperative position thereof and which is supported by a cable (17) connected to a winch (19) mounted on a platform (13) fixedly connected to the upper part of the main barrier element (4), on this platform being also mounted the devices provided for driving the revolving drum (22).

2. A barrier according to claim 1, wherein the barrier sections (1) are each constituted of a continuous strip of plasticized or padded cloth or of a flexible metal sheet carried by interposed spaced floating cylindrical bodies (3) made of foamed plastic material or the like and each provided at its lower end with a counterweight body (3*a*).

3. A barrier according to claim 1, wherein each main barrier element (4) is constituted, in combination, of two semiannular hollow caissons (7) having vertical round end corners (7*a*), the ends (7*a*) of the semiannular caissons (7) being connected to each other by spacing straps (8) designed to form side entrance passages through which are inserted removable vertical bars (6) provided for locking said entrance orifices.

4. A barrier, according to claim 1, wherein the main barrier elements (4) are self-floating, owing to the buoyancy of the peripheral annular caisson or caissons (7) and owing to a central tubular floating caisson 15 carried at the inside of the cylindrical wall (14) as well as owing to a floating annular caisson (34) fixed about the revolving drum (22).

5. A barrier, according to claim 1, wherein each main barrier element (4) consists of a carrying structure comprising the annular peripheral caisson or caissons (7) connected by upper tie rods (11) to the platform (13) from which depends the central cylindrical wall (14), connected by lower connecting tie rods (12) to the peripheral caisson or caissons (7), on said platform (13) being mounted the means (25, 26 and 27) for transmitting a motion of rotation to the drum (22) in both directions in order to let the barrier section or sections (1) to be wound about or unwound from the drum (22) as well as the winch (19) for winding or unwinding the cable (17) supporting the anchoring body (18), these means being actuated manually or by an engine.

6. A barrier, according to claim 1, wherein each main barrier (4) is provided with upper handles (29), which serve for the manoeuvering, lifting, towing thereof after at least one barrier section (1) has been received and wound around the drum (22) or for the transport of the same on its use site.

* * * * *